US011738280B2

(12) United States Patent
Clark

(10) Patent No.: US 11,738,280 B2
(45) Date of Patent: Aug. 29, 2023

(54) EXPANDABLE AND COLLAPSIBLE PLUSH TOY

(71) Applicant: Randy Wayne Clark, Strathmore, CA (US)

(72) Inventor: Randy Wayne Clark, Strathmore, CA (US)

( * ) Notice: Subject to any disclaimer, the term of this patent is extended or adjusted under 35 U.S.C. 154(b) by 0 days.

(21) Appl. No.: 16/055,328

(22) Filed: Aug. 6, 2018

(65) Prior Publication Data

US 2019/0038982 A1 Feb. 7, 2019

Related U.S. Application Data

(60) Provisional application No. 62/542,087, filed on Aug. 7, 2017.

(51) Int. Cl.

| | |
|---|---|
| ***A63H 3/04*** | (2006.01) |
| ***A63H 9/00*** | (2006.01) |
| ***A63H 3/46*** | (2006.01) |
| ***A63H 3/44*** | (2006.01) |
| ***A63H 3/28*** | (2006.01) |

(52) U.S. Cl.

CPC ..... *A63H 3/04* (2013.01); *A63H 3/28* (2013.01); *A63H 3/44* (2013.01); *A63H 3/46* (2013.01); *A63H 9/00* (2013.01)

(58) Field of Classification Search

CPC ... A63H 3/02; A63H 3/04; A63H 3/28; A63H 3/44; A63H 3/46; A63H 9/00

USPC ..... 446/320, 370, 373, 374

See application file for complete search history.

(56) References Cited

U.S. PATENT DOCUMENTS

| | | | | | |
|---|---|---|---|---|---|
| 1,456,422 | A * | 5/1923 | Cabana | A63H 3/46 | 446/381 |
| 2,073,723 | A * | 3/1937 | Woolnough | A63H 3/02 | 446/370 |
| 3,292,610 | A * | 12/1966 | Newman | A63H 3/48 | 600/27 |
| 3,552,057 | A * | 1/1971 | De Laillevault | A63H 3/04 | 446/374 |
| 3,645,038 | A * | 2/1972 | Morrison | A63H 3/04 | 446/320 |
| 3,828,462 | A | 8/1974 | Morrison et al. | | |
| 4,245,426 | A * | 1/1981 | Sullivan | A63H 3/005 | 297/181 |
| 4,259,805 | A * | 4/1981 | Hornsby, Jr. | A63H 13/16 | 446/198 |

(Continued)

FOREIGN PATENT DOCUMENTS

| | | | | |
|---|---|---|---|---|
| FR | 2 834 911 A1 | 7/2003 | | |
| GB | 1477194 A * | 6/1977 | | A63H 23/02 |

*Primary Examiner* — Joseph B Baldori

(74) *Attorney, Agent, or Firm* — Orbit IP

(57) ABSTRACT

A plush toy includes a rigid body and a plurality of expandable, articulable and positionable tubes each extending from a proximal tube end to a distal tube end. Each proximal tube end is attached to the rigid body. At least two rigid hollow bases are each filled with weighting material. Each rigid base is attached a respective distal tube end of one of the plurality of tubes. A fabric covering surrounds the entirety of the rigid body, the plurality of tubes and the at least two rigid hollow bases. A compressible packing material is disposed inside of the fabric covering and outside of the rigid body, the plurality of tubes and/or the at least two rigid hollow bases. The fabric covering resembles an animal. At least one of the plurality of tubes represents an arm, a leg, a neck, a tail or a horn of the animal.

19 Claims, 12 Drawing Sheets

(56) References Cited

U.S. PATENT DOCUMENTS 4,579,538 A 4/1986 Bass et al.
4,583,957 A * 4/1986 Levy ..... A63H 3/48 446/177
4,619,625 A * 10/1986 Seki ..... A63H 17/002 446/197
4,696,653 A 9/1987 McKeefery
4,784,382 A * 11/1988 Myers ..... A47B 19/04 248/460
4,968,281 A 11/1990 Smith et al.
5,310,380 A * 5/1994 Levy ..... A63H 3/36 446/320
5,507,678 A * 4/1996 Chiang ..... A63H 3/36 446/369
6,155,904 A * 12/2000 Spector ..... A63B 69/345 446/311
6,439,946 B1 8/2002 Schneider
6,749,479 B2 * 6/2004 Vick ..... A61L 9/12 446/369
6,783,424 B2 * 8/2004 Choi ..... A63H 3/02 446/370
6,932,669 B2 * 8/2005 Lee ..... A63H 3/46 264/230
7,507,138 B2 * 3/2009 Chernick ..... A63H 3/02 446/268
8,282,439 B2 10/2012 Han
10,226,711 B1 * 3/2019 Jin ..... A63H 3/46
2007/0066180 A1 * 3/2007 Marietta ..... A63H 17/00 446/56
2013/0154189 A1 6/2013 Fish
2014/0199912 A1 7/2014 Fish
2016/0263486 A1 * 9/2016 Strong ..... A63H 7/02
2019/0038982 A1 * 2/2019 Clark ..... A63H 3/44

* cited by examiner

EXPANDABLE AND COLLAPSIBLE PLUSH TOY

CROSS-REFERENCE TO RELATED APPLICATIONS

This application claims priority to the provisional application 62/542,087 filed on Aug. 7, 2017, the entire contents of which are hereby incorporated by reference.

DESCRIPTION

Field of the Invention

The present invention generally relates to plush toys. More particularly, the present invention relates to a plush toy having a multitude of body parts that can be expanded and contracted and also positioned into various poses by a child for increased fun and interest.

Background of the Invention

Plush toys have been a staple of the toy industry for decades. Accordingly, there is always a need for a new and novel plush toy that can capture the attention of children. The present invention fulfills these needs and provides other related advantages.

SUMMARY OF THE INVENTION

An exemplary embodiment of the present invention is a plush toy 10 that includes a rigid body 12. At least one expandable, articulable and positionable tube 14 extends from a proximal tube end 14*p* to a distal tube end 14*d*. The proximal tube end 14*p* is attached to the rigid body 12. A rigid hollow base 16 is filled with at least one weighting material 18. The rigid base 16 is attached to the distal tube end 14*d* of the at least one expandable, articulable and positionable tube 14. A fabric covering 20 surrounds the entirety of the rigid body 12, the at least one expandable, articulable and positionable tube 14 and the rigid hollow base 16.

In other exemplary embodiments, the rigid body may be hollow 22. The rigid hollow body 12, 22 may comprise a first body portion 12*a* attached to a second body portion 12*b* thereby forming the rigid hollow body 12. The first body portion may comprise a first half 24*a* of a cutout 24 and the second body portion may comprise a second half 24*b* of the cutout 24. The first and second body portions may be attached the first half and second half form the cutout, wherein a portion of the proximal tube end 14*p* is captured in the cutout 24 thereby attaching the proximal tube end to the rigid hollow body.

The first body portion 12*a* may be attached to the second body portion 12*b* by fasteners 26. Alternatively, the first body portion 12*a* may attach to the second body portion 12*b* by an integrally formed snap feature 28 of the first and second body portions. Additionally, the first body portion and second body portion can be pivotably connected by a hinge feature 30.

A compressible packing material 32 may be disposed inside of the fabric covering and outside of the rigid body, the at least one expandable, articulable and positionable tube and/or the rigid hollow base. Furthermore, a second compressible packing material 34 may be disposed inside of the rigid body, the at least one expandable, articulable and positionable tube and/or the rigid hollow base.

The at least one weighting material 18 may comprise a plurality of metal or plastic beads, stones, rocks, sand or even liquids such as water.

The at least one weighting material is sealed 36 within the rigid hollow base.

The fabric covering 20 may resembles an animal. For example, the at least one expandable, articulable and positionable tube 14 may represent an arm, a leg, a neck, a tail or a horn of the animal.

In other embodiments, the rigid body 12 may comprise a single component 12*c* of an injection molded part.

The center of gravity 38 of the plush toy may be below the rigid body.

The rigid hollow base has a bottom surface area ratio that may include at least 6 inches squared for every 10 inches in maximum height of the plush toy in an expanded state.

A button 40 may be electrically connected to a speaker 42, and the speaker may be configured to play various sounds when the button is pressed.

A door 44 may be attached to the rigid body, accessible through the fabric covering, opening into the rigid hollow body.

In another embodiment of the present invention, a plush toy 10, comprises: a rigid body 12; a plurality of expandable, articulable and positionable tubes 14 each extending from a proximal tube end 14*p* to a distal tube end 14*d*, wherein each proximal tube end 14*p* is attached to the rigid body 12; at least two rigid hollow bases 16 each filled with weighting material 18, wherein each rigid base 16 is attached a respective distal tube end 14*d* of one of the plurality of expandable, articulable and positionable tubes 14; a fabric covering 20 surrounding the entirety of the rigid body 12, the plurality of expandable, articulable and positionable tubes 14 and the at least two rigid hollow bases 16; and a compressible packing material 32 disposed inside of the fabric covering and outside of the rigid body, the plurality of expandable, articulable and positionable tubes and/or the at least two rigid hollow bases; wherein the fabric covering 20 resembles an animal; and wherein at least one of the plurality of expandable, articulable and positionable tubes 14 represents an arm, a leg, a neck, a tail or a horn of the animal.

Other features and advantages of the present invention will become apparent from the following more detailed description, when taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 9:
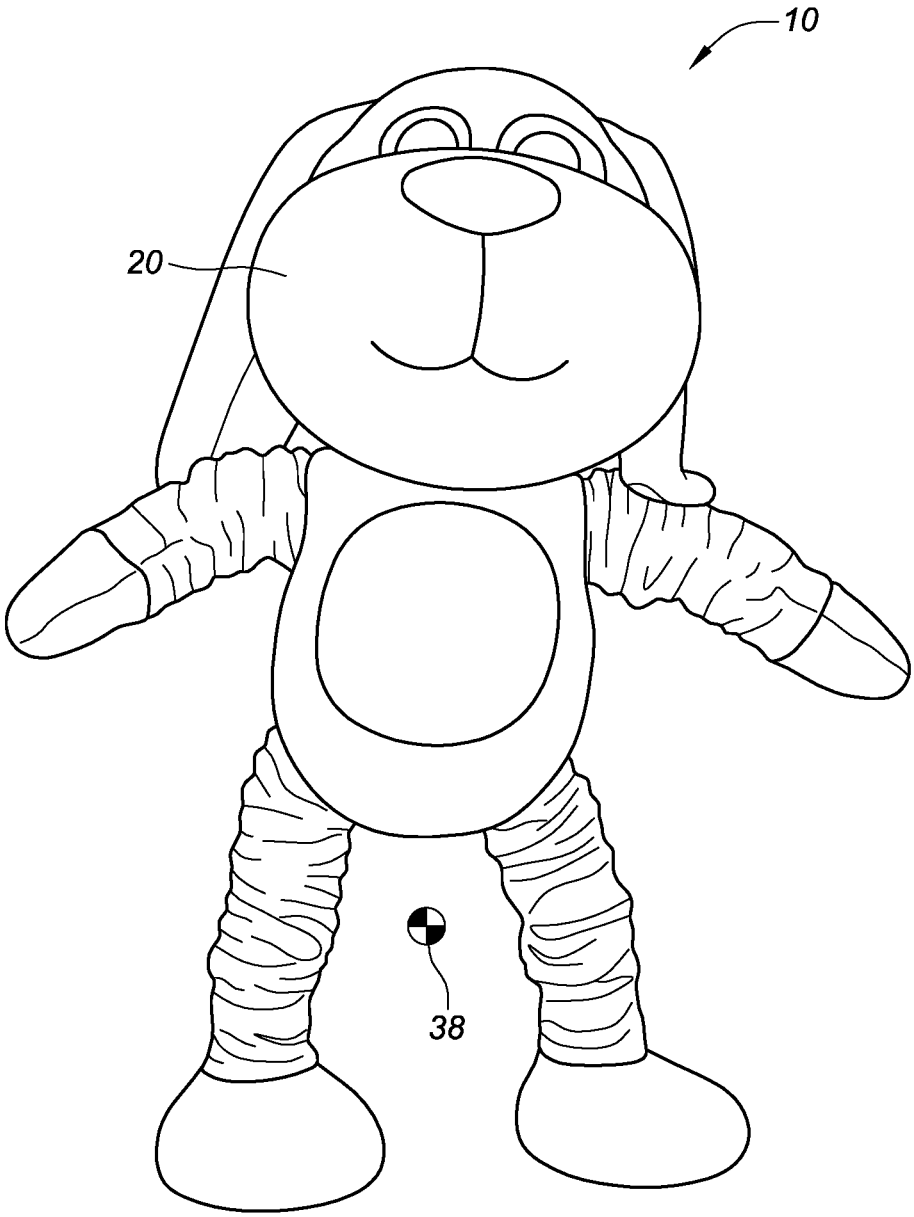
FIG. 9 is an isometric view of an exemplary embodiment of the present invention in the form of a dog.
Figure 10:
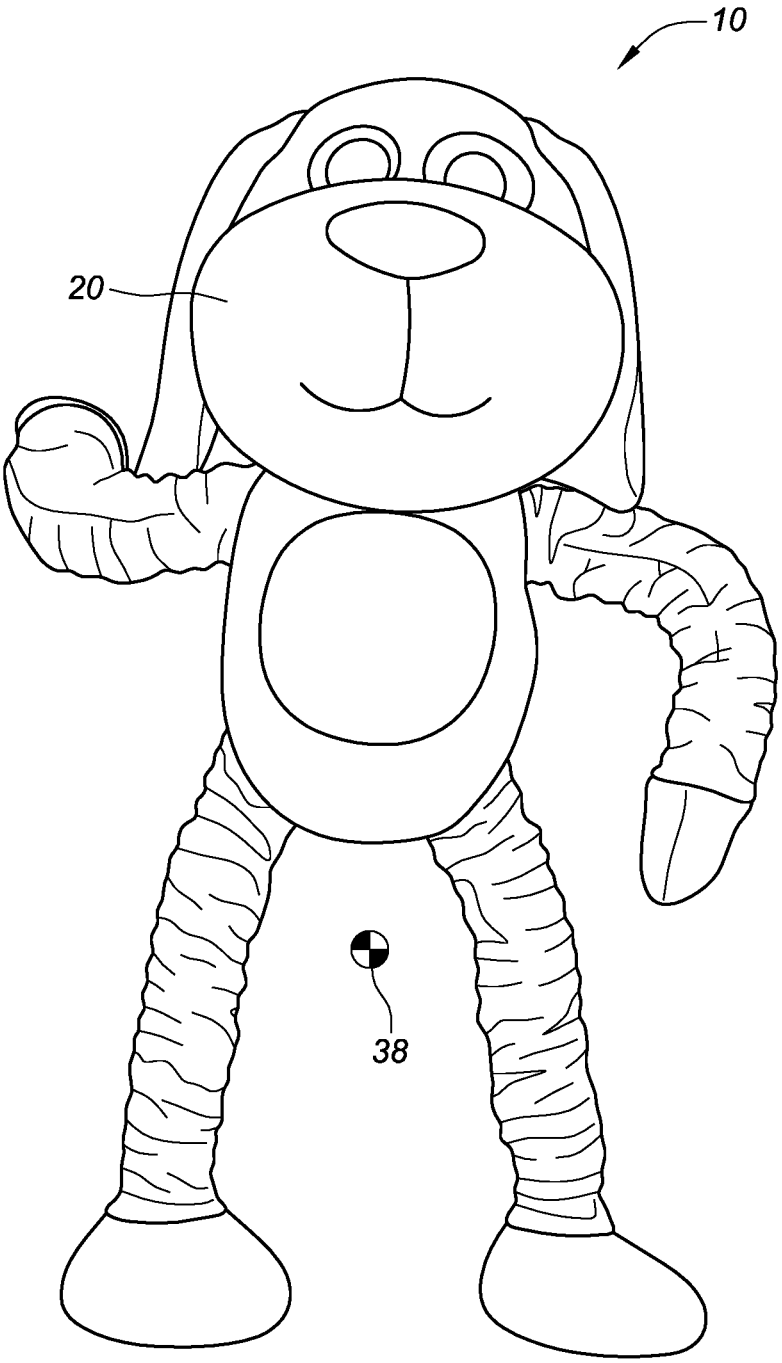
FIG. 10 is an isometric view of the structure of FIG. 9 now showing the arms and legs manipulated to extend and bend.

An exemplary embodiment of the present invention is best shown in FIGS. 9 and 10. One can notice that the arms and legs are expandable and can be manipulated to hold their position. The feet are weighted such that the plush toy 10 can remain in an upright position when stood. This detailed description will now teach how such a toy can be cheaply and easily manufactured.

Figure 1:
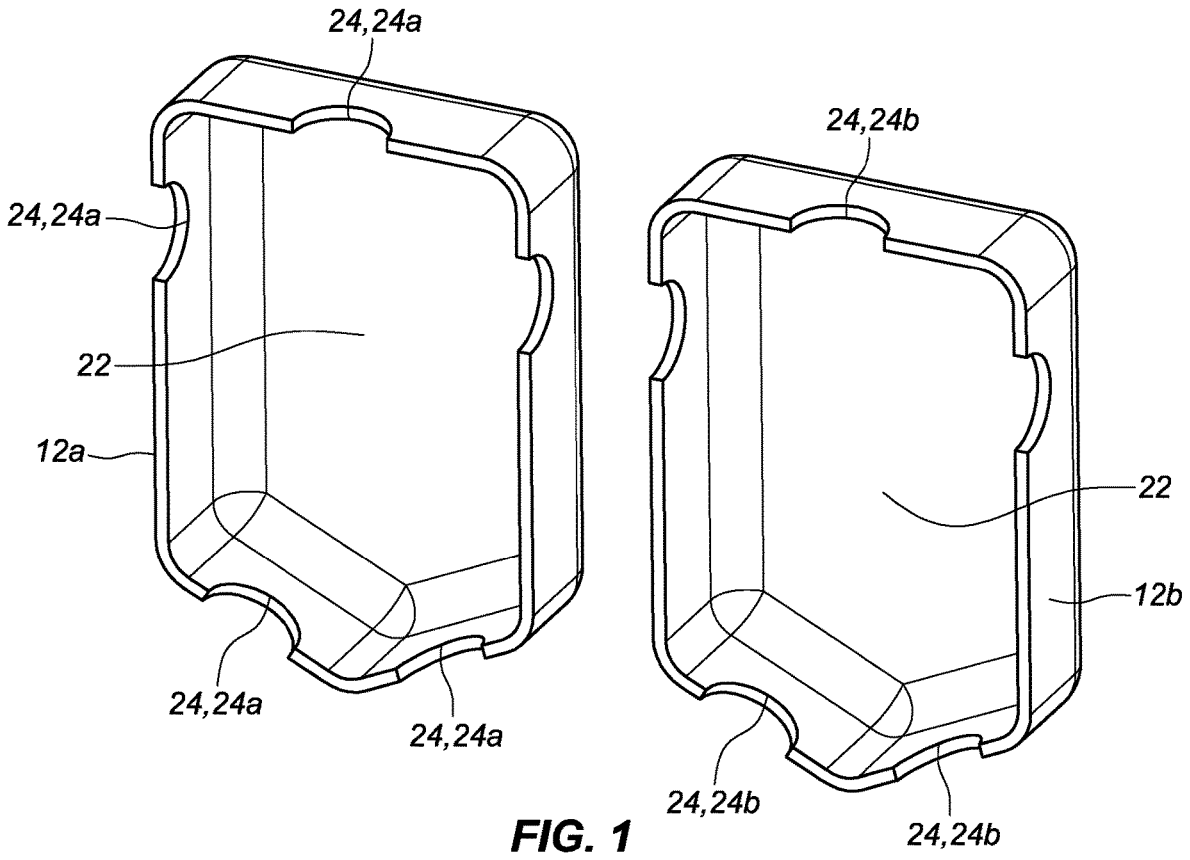
FIG. 1 is an isometric view of two halves of the rigid hollow body.
Figure 2:
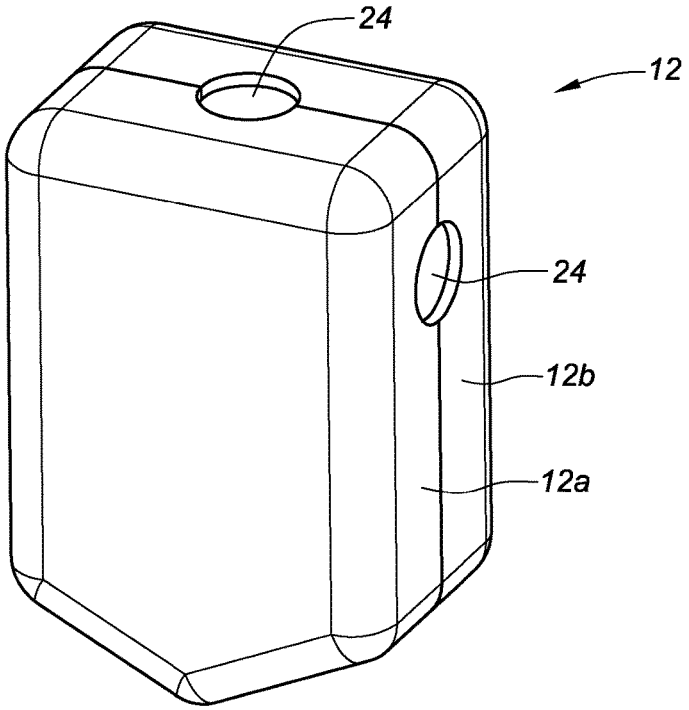
FIG. 2 is an isometric view of the structure of FIG. 1 where the two halves are connected to form a rigid hollow body.

The plush toy 10 includes a rigid body 12. As best shown in FIGS. 1 and 2 the rigid body 12 may be hollow 22. The rigid hollow body 12, 22 may comprise a first body portion 12*a* attached to a second body portion 12*b* thereby forming the rigid hollow body 12.

As used herein in this specification the term "rigid" means unable to bend or be forced out of shape; i.e. not flexible. Of course, it is understood by those skilled in the art that even the most rigid structure can be bent or deformed under enough force. However, this amount of force is not contemplated herein. For example, something that is rigid, such as a plastic rigid body, has enough strength to not be bent when in use by a person, such that the rigid body sufficiently holds its shape in use. It is understood that while the body is rigid, the arms and legs are not rigid in that the arms and legs can be moved and positioned into various positions.

The body 12 in this case is made up of two halves. However, the body 12 could be made from one part, two parts, three parts or any number of parts. The body 12 is the central support/frame such that a multitude of expandable tubes can be therefore attached. As can be appreciated, the body can be made from a variety of materials and in a variety of shapes, including plastics, wood, metals, composites or combinations thereof.

Figure 2A:
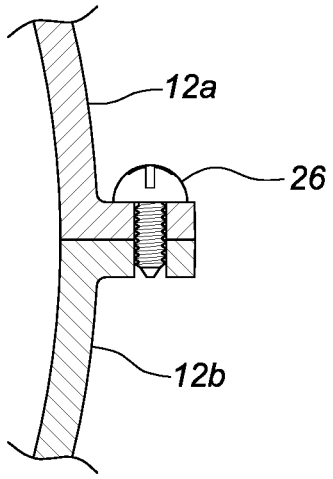
FIG. 2A is an enlarged sectional view showing the use of fasteners to join to two rigid body halves.
Figure 2B:
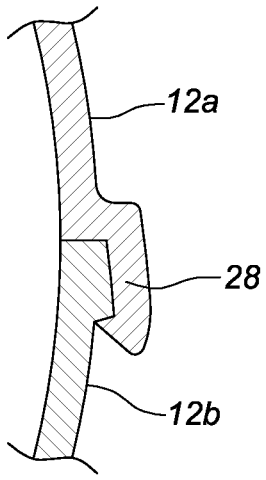
FIG. 2B is an enlarged sectional view showing the use of a snap feature to join the rigid body halves.
Figure 2C:
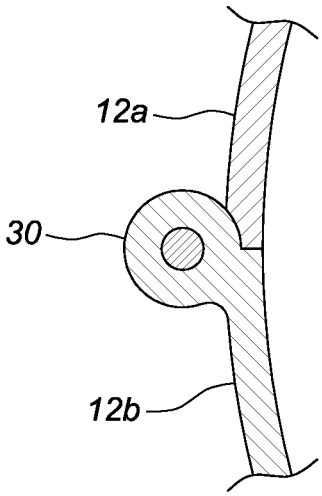
FIG. 2C is an enlarged sectional view showing the use of a pivotable hinge feature.
Figure 3:
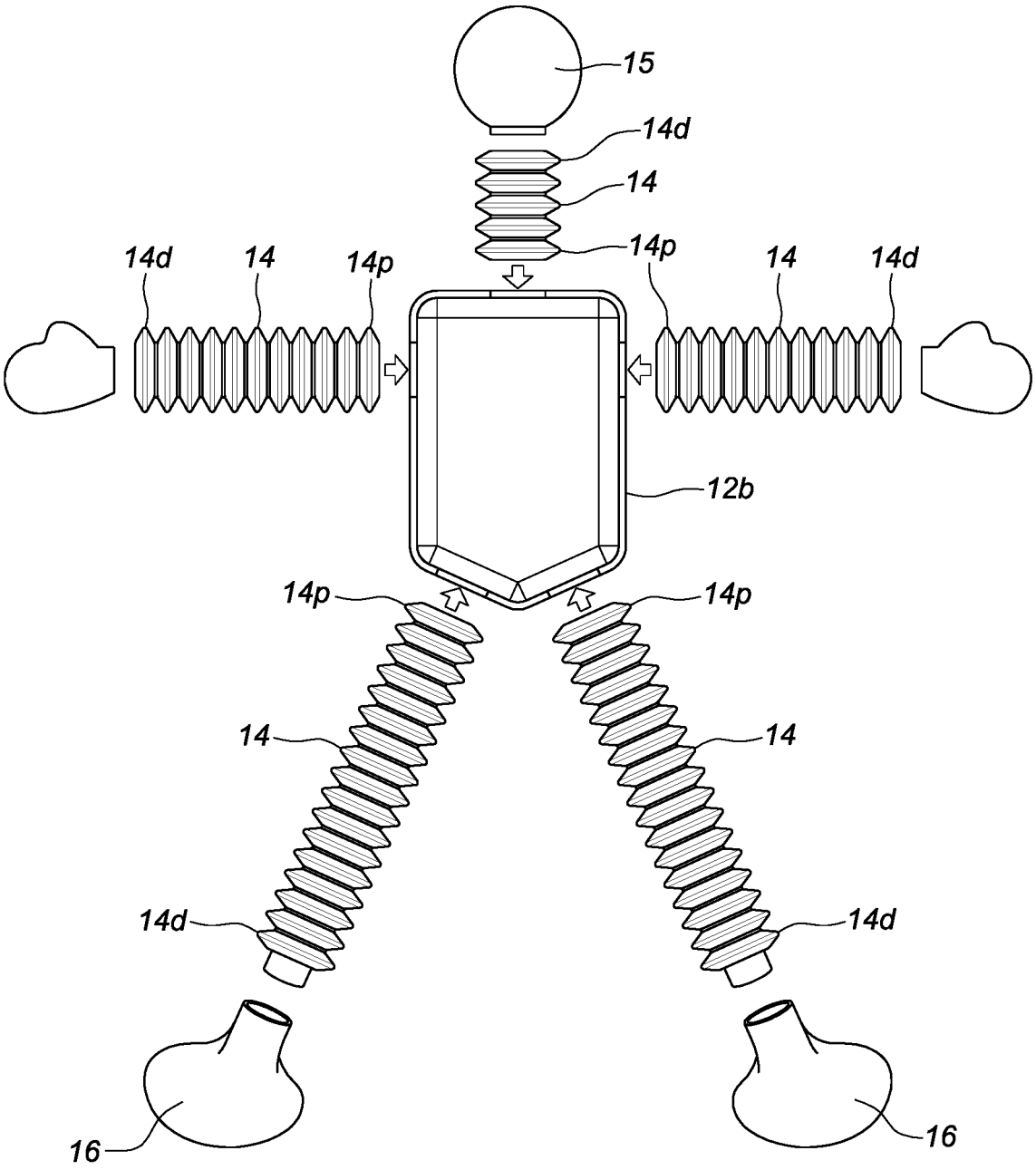
FIG. 3 is an exploded isometric view before assembling the tubes into the rigid hollow body structure.
Figure 4:
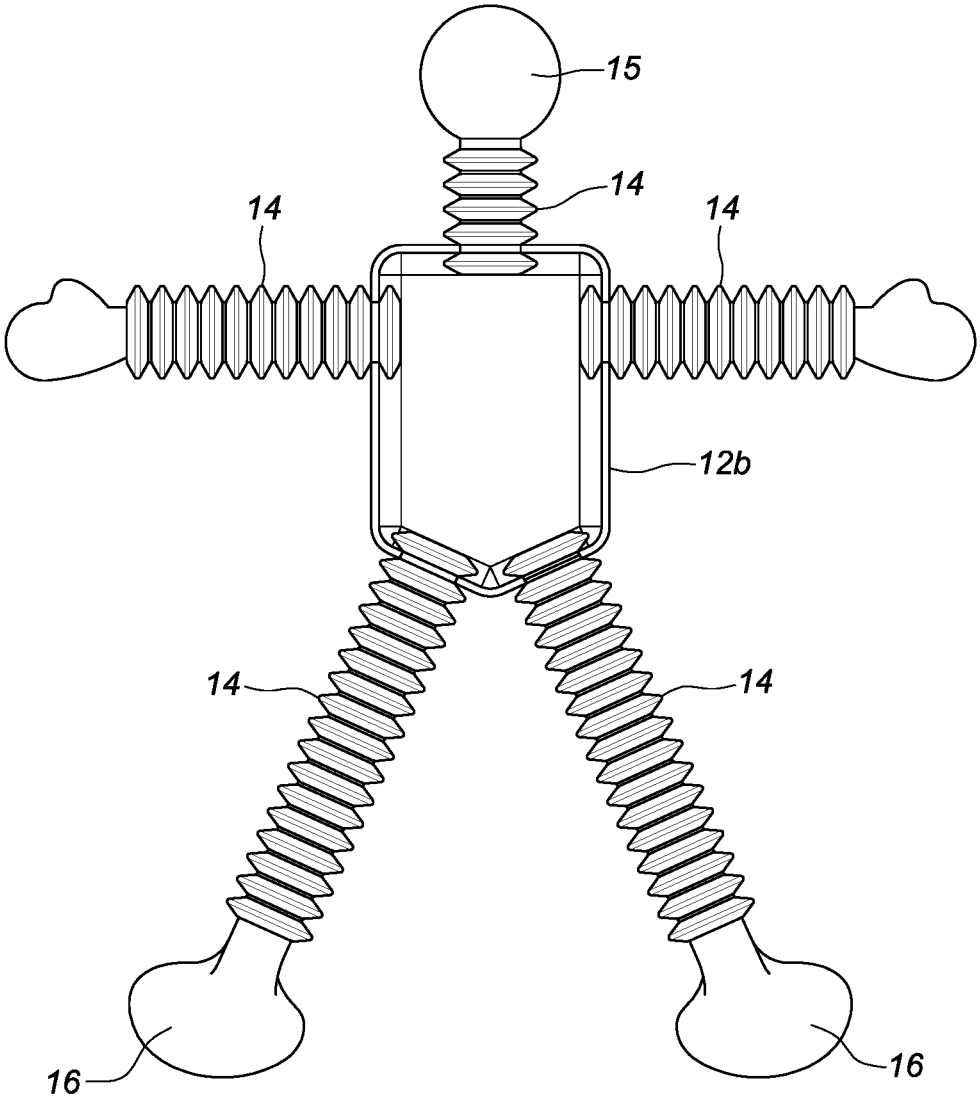
FIG. 4 is an isometric view of the structure of FIG. 3 now showing the tubes slid into various cutouts formed int the rigid hollow body.
Figure 5:
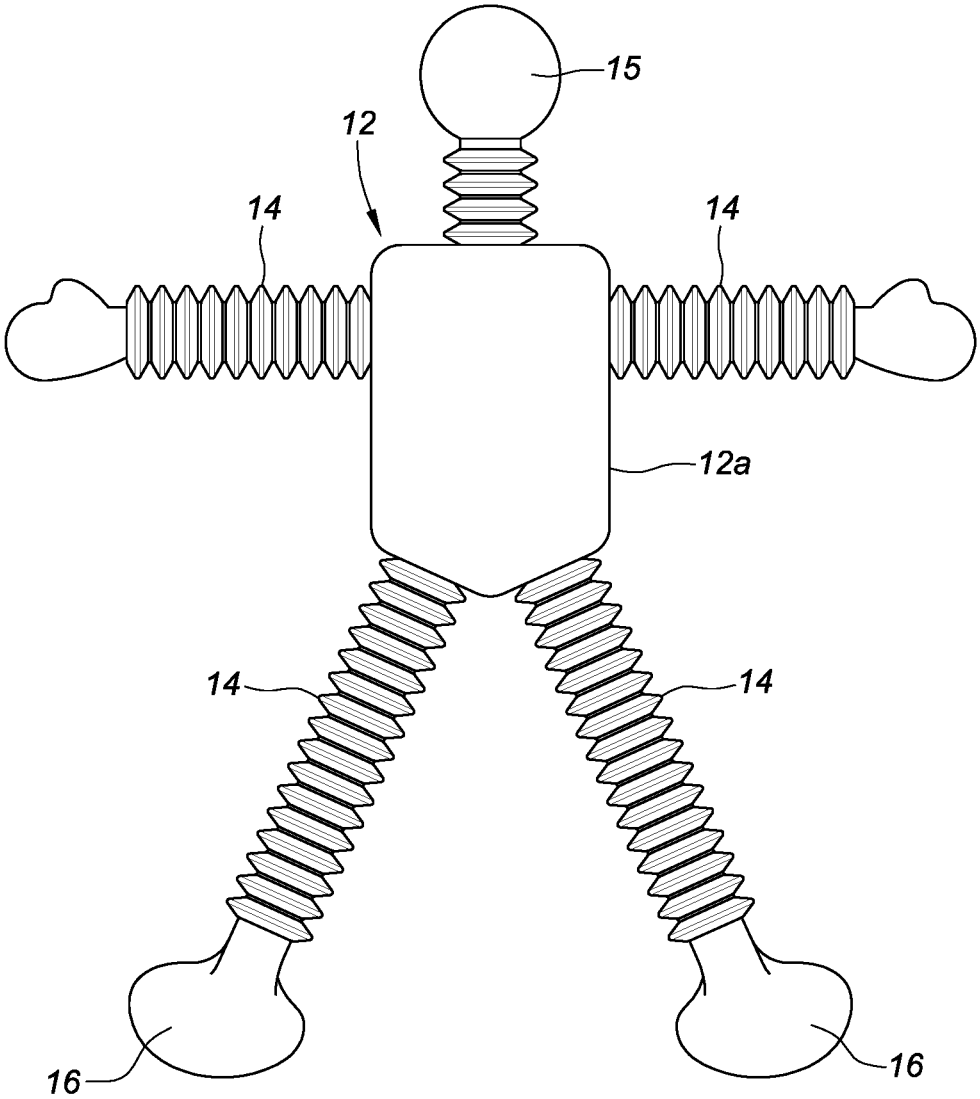
FIG. 5 is an isometric view of the structure of FIGS. 3 and 4 now showing the front body portion and back body portion connected together thereby securing the tubes in place.
Figure 6:
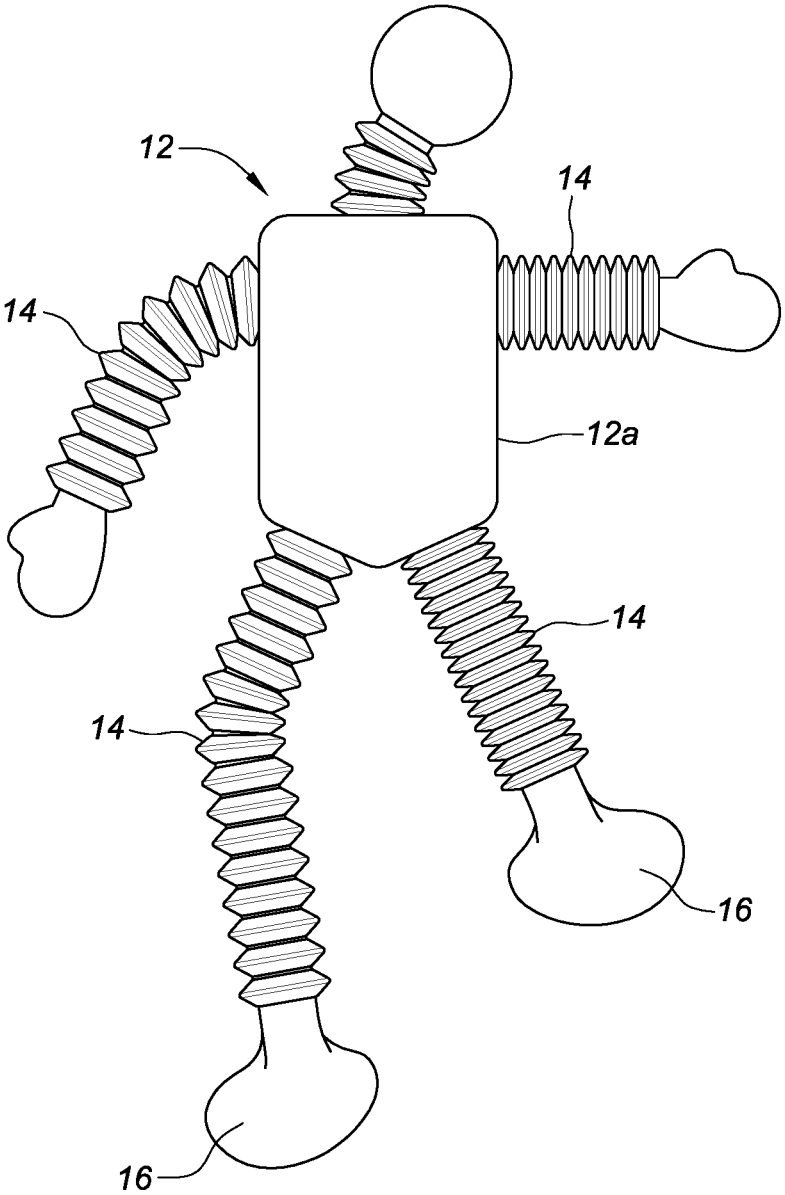
FIG. 6 is an isometric view of the structure of FIG. 5 now showing how the tubes can expand, articulate and hold their position.

As shown in FIG. 2A the first body portion 12*a* may be attached to the second body portion 12*b* by fasteners 26. Alternatively, as shown in FIG. 2B the first body portion 12*a* may attach to the second body portion 12*b* by an integrally formed snap feature 28 of the first and second body portions. Additionally, as shown in FIG. 2C the first body portion and second body portion can be pivotably connected by a hinge feature 30. The body 12 may use a combination of these joining techniques or even be glued/bonded together with an adhesive.

As best shown in FIGS. 3-6, at least one expandable, articulable and positionable tube 14 (i.e. not rigid) extends from a proximal tube end 14*p* to a distal tube end 14*d*. The proximal tube end 14*p* is attached to the rigid body 12. The expandable tubes 14 are generally plastic, and are made in a form that can be pulled to expand or pushed to collapse. This particular design is similar in concept to how an expandable straw works. The internal resistance of the tubing itself can hold its shape once it is manipulated into a particular form. In this way, a user can pull, push and bend the expandable tubes into a desired shape or form. Therefore, the tubes can perform three functions in that they can be (1) expandable, (2) articulable and (3) positionable. Expandable means that they can take the form of a variety of lengths. Collapsing the tubes makes them shorter in length whereas expanding the tubes makes them longer in length. Articulable means the tubes can bend into various angles. Finally, positionable means that when either expanded/collapsed or bent/straight the tubes have enough internal resistance to hold their position. In this manner a child can create countless positions of the plush toy for increased play and satisfaction.

In this particular embodiment, four tubes are attached to the body to represent the arms and legs. As shown, another tube is shown for the neck that could attach to a head structure 15. For attaching the tubes 14, the first body portion may comprise a first half 24*a* of a cutout 24 and the second body portion may comprise a second half 24*b* of the cutout 24. The first and second body portions may be attached the first half and second half form the cutout, wherein a portion of the proximal tube end 14*p* is captured in the cutout 24 thereby attaching the proximal tube end to the rigid hollow body. As can be appreciated by those skilled in the art, the tubes 14 can be attached to the body 12 in a variety of other ways and methods, including using fasteners, adhesives and other joining structures.

Figure 7:
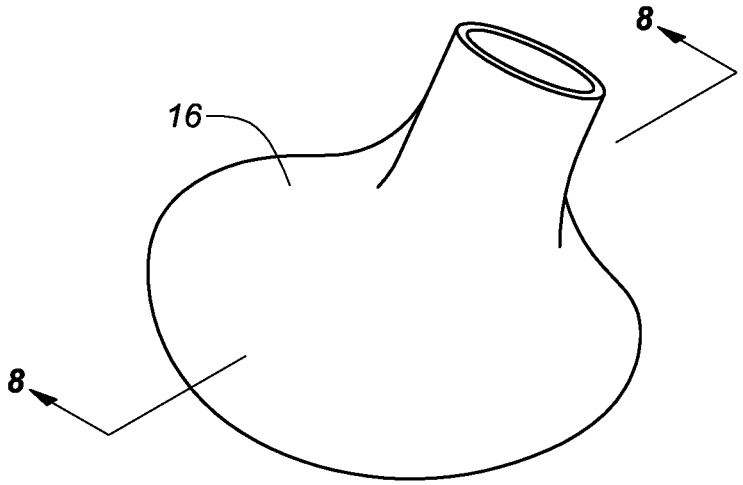
FIG. 7 is an isometric view of a rigid hollow base.
Figure 8:
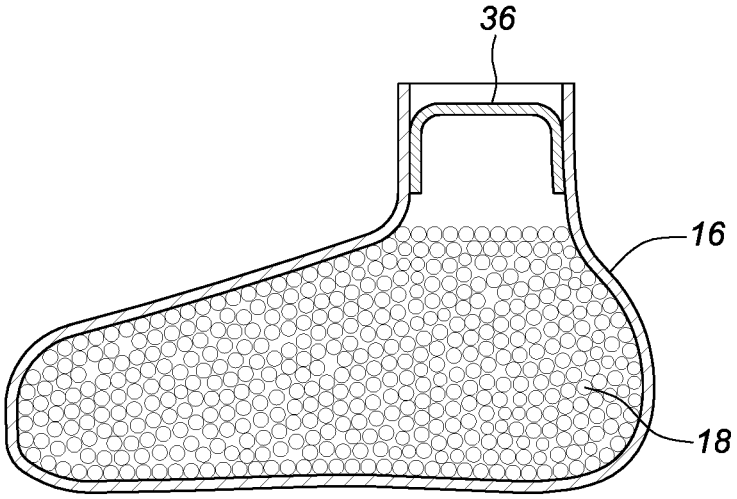
FIG. 8 is a sectional view of the rigid hollow base showing the weighting material disposed inside.

As best seen in FIGS. 7-8 a rigid hollow base (feet) 16 is filled with at least one weighting material 18. The at least one weighting material is sealed within the rigid hollow base by a seal 36. The rigid base 16 is attached to the distal tube end 14*d* of the at least one expandable, articulable and positionable tube 14. In this case the feet 16 are hollow plastic shells which then allows beads 18 or various other weights 18 to be placed within. The at least one weighting material 18 may comprise a plurality of metal or plastic beads, stones, rocks, sand or even liquids such as water.

It is understood that the feet 16 could simply be made with heavy materials, or be constructed from dense materials. The purpose of the feet 16 are to provide a low center of gravity such that the finished toy can be stood upright and not fall over. Therefore, the feet are generally wide such that they provide a good support for standing on their own. In this case the feet are at least 2"-3" in diameter. As a generally rule of thumb, the surface area of the combined feet should have a ratio with respect to the maximum height of the plush toy to be about 2" in diameter per 10" in height. Furthermore, the rigid hollow base has a bottom surface area ratio that may include at least 6 inches squared for every 10 inches in maximum height of the plush toy in an expanded state.

Accordingly, as best shown in FIGS. 9-10 the center of gravity 38 of the plush toy is below the rigid body 12. In this manner the plush toy 10 can remain upright on its own when positioned properly. The center of gravity is key in order for the plush toy 10 to stand and pose. The key is to have the feet 16 have enough weight to hold body and to have the internal body 12, 14 to be as light as possible to keep a low center of gravity.

Referring once again to FIGS. 9-10, a fabric covering 20 surrounds the entirety of the rigid body 12, the at least one expandable, articulable and positionable tube 14 and the rigid hollow base 16. The fabric covering 20 may resemble an animal. For example, the at least one expandable, articulable and positionable tube 14 may represent an arm, a leg, a neck, a tail or a horn of the animal. As can be appreciated, the various characters that one could form into such a plush toy are endless. For example, the plush toy could resemble humans, cartoon characters, animals, aliens, robots, mythical creatures or even inanimate objects. The possibilities are endless, therefore, this teaching is not just limited to the specific embodiment shown herein.

Figure 11:
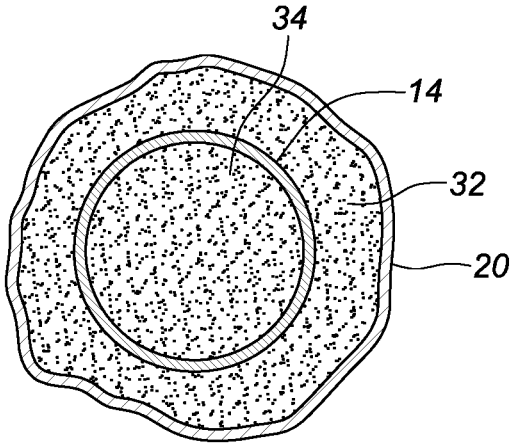
FIG. 11 is a sectional view taken through a tube section showing compressible packing material inside of the fabric covering and inside of the tube.
Figure 12:
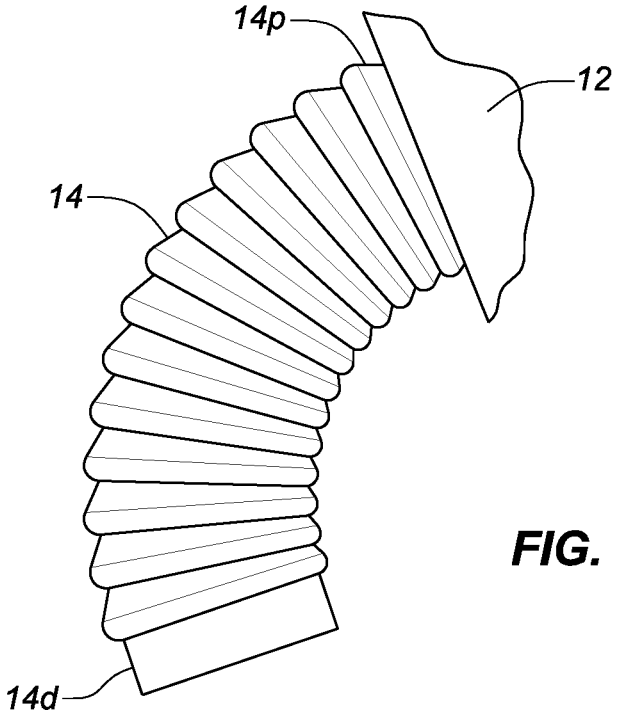
FIG. 12 is an enlarged view of the tube showing how it can expand, bend and hold its position.

It is appreciated that the plush outer covering 20 can also include padding or foam to increase its touchability and to decrease a user from feeling the internal mechanisms. For example, as best seen in FIG. 11, a compressible packing material 32 may be disposed inside of the fabric covering and outside of the rigid body, the at least one expandable, articulable and positionable tube and/or the rigid hollow base.

Furthermore, a second compressible packing material 34 may be disposed inside of the rigid body, the at least one expandable, articulable and positionable tube and/or the rigid hollow base. This second compressible packing material 34 may help to provide support to the tubes to hold their shape once positioned.

Figure 13:
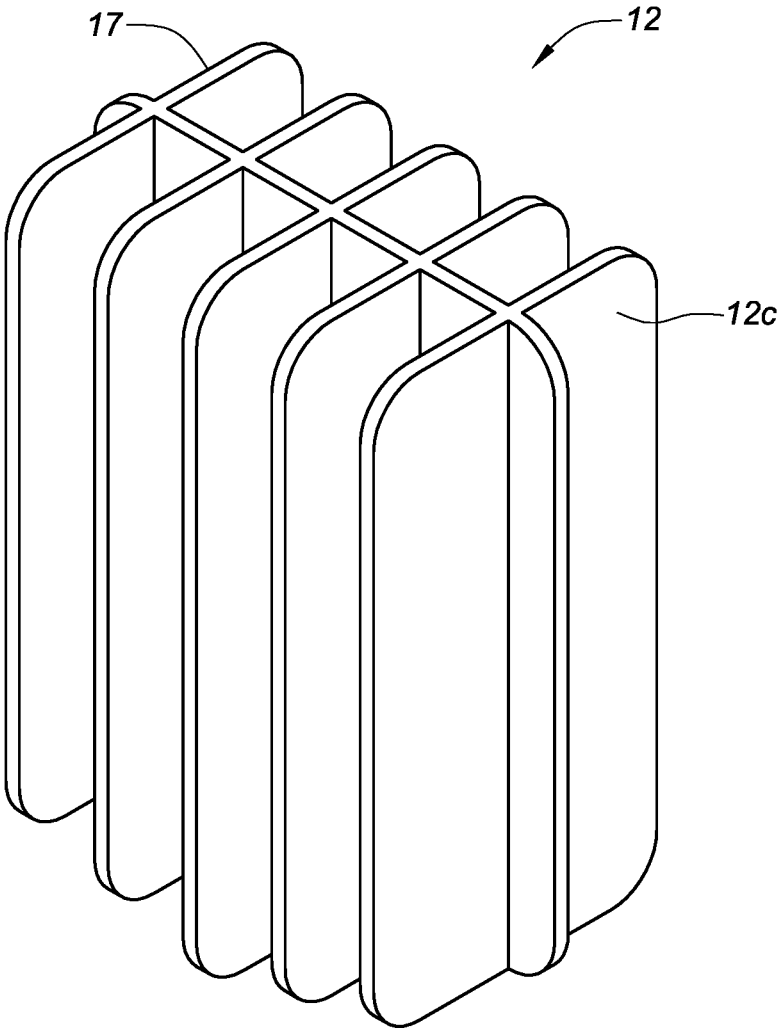
FIG. 13 is an isometric view of another embodiment of the rigid body that is formed as a single integral part from an injection molded manufacturing method.

As best shown in FIG. 13, the rigid body 12 may comprise a single component 12*c* of an injection molded part. For example a plurality of ribs 17 may be used to provide space to create the same volume as the body 12 shown in FIG. 2. As can be appreciated by those skilled in the art, there are a multitude of ways to create a rigid body structure 12.

Figure 14:
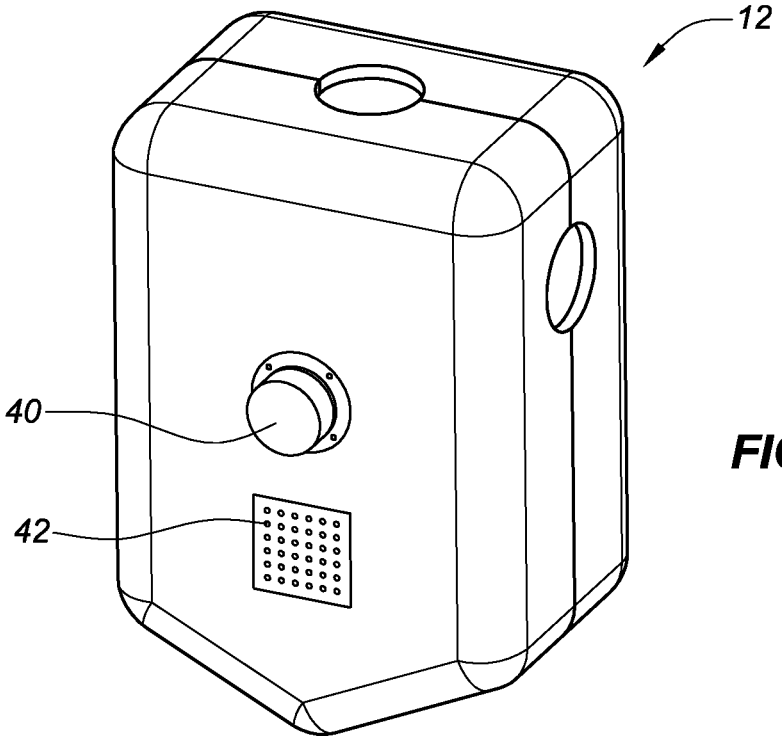
FIG. 14 is an isometric view showing how a button, speaker and associated electronics can be integrated into the rigid body structure.

Now referring to FIG. 14, a button 40 may be electrically connected to a speaker 42, and the speaker may be configured to play various sounds when the button is pressed. Accordingly, the plush toy 10 would include the necessary batteries, circuitry and microchip/circuit board required for such functions.

Figure 15:
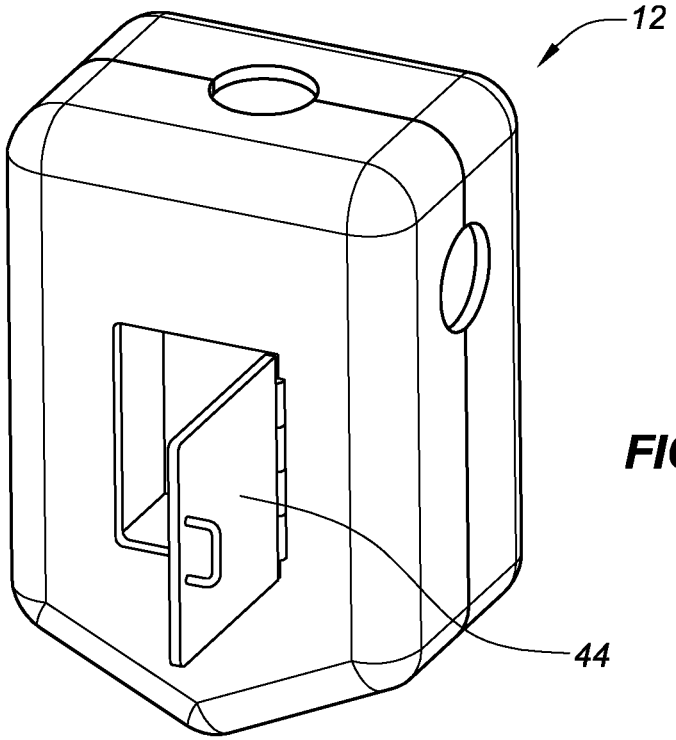
FIG. 15 is an isometric view showing how a door can be pivotably attached to the rigid hollow body such that a child can store various items inside.

Now referring to FIG. 15, a door 44 may be attached to the rigid body, accessible through the fabric covering, opening into the rigid hollow body. The body 12 could now open up and act as a safe or storage for other toys and collectables.

As can now be appreciated the inventors have created a novel unique toy which are named Bendamals™ as a line of expandable articulation plush using a custom plastic telescoping tubes in the arms and legs to expand or contract the size of each limb. The plush can double in size when fully expanded out. Once expanded out, the user can twist and turn the articulation to hold and pose the arms/legs in a pose. Each foot is weighted so the character has the ability to stand up while posing. Each plush character also has a unique feature. For example, the monkey has a tail that can expand, the unicorn's horn can expand, and the giraffe's neck can expand.

The inventors are making three sizes: micro, small, and large. However, any number of sizes can be made. The micro size will be 2.5" when contracted but 4" when expanded. The small size will be 7" when contracted but 12" when expanded. The large size will be 16" when contracted but 24" when expanded. The weight of the product depends on the height. Currently the inventors are making the micro size with weight of 10 ounces, the small size with an estimated weight of 16 ounces and the large size with estimated weight of 30 ounces.

Although several embodiments have been described in detail for purposes of illustration, various modifications may be made to each without departing from the scope and spirit of the invention. Accordingly, the invention is not to be limited, except as by the appended claims.

REFERENCE NUMERALS

10 plush toy
12 rigid body
12*a* first body portion, rigid body
12*b* second body portion, rigid body
14 expandable, articulable and positionable tube
14*p* proximal end of the expandable, articulable and positionable tube
14*d* distal end of the expandable, articulable and positionable tube
15 head structure
16 rigid hollow base
17 ribs
18 weighting material
20 fabric covering
22 hollow, rigid body
24 cutout
24*a* first half, cutout
24*b* second half, cutout
26 fasteners
28 integrally formed snap feature
30 hinge feature
32 compressible packing material
34 compressible packing material
36 seal
38 center of gravity
40 button
42 speaker
44 door

What is claimed is:

1. A plush toy, comprising:

a rigid body;

at least a first expandable, articulable and positionable tube extending from a proximal tube end to a distal tube end, wherein the proximal tube end is attached to the rigid body;

a rigid hollow base filled with at least one weighting material, wherein the rigid hollow base is attached to the distal tube end of the at least the first expandable, articulable and positionable tube, wherein the rigid hollow base is configured to support the plush toy in a standing pose, and wherein the rigid hollow base has a bottom surface area ratio that includes at least 6 inches squared for every 10 inches in maximum height of the plush to in an expanded state;

at least a second expandable, articulable and positionable tube extending from a proximal tube end to a distal tube end, wherein the proximal tube end is attached to the rigid body, and wherein the at least one weighting material is not attached to the second expandable, articulable and positionable tube, wherein the second expandable, articulable and positional tube is not configured to support the plush toy in the standing pose; and a continuous and integrally formed plush fabric covering surrounding the entirety of the rigid body, the at least first and second expandable, articulable and positionable tubes and the rigid hollow base.

2. The plush toy of claim 1, wherein the rigid body is hollow.

3. The plush toy of claim 2, wherein the rigid hollow body comprises a first body portion attached to a second body portion thereby forming the rigid hollow body.

4. The plush toy of claim 3, wherein the first body portion comprises a first half of a cutout and the second body portion comprises a second half of the cutout, wherein when the first and second body portions are attached the first half and second half form the cutout, wherein a portion of the proximal tube end is captured in the cutout thereby attaching the proximal tube end to the rigid hollow body.

5. The plush toy of claim 4, wherein the first body portion attaches to the second body portion by fasteners.

6. The plush toy of claim 4, wherein the first body portion attaches to the second body portion by an integrally formed snap feature of the first and second body portions.

7. The plush toy of claim 4, wherein the first body portion and second body portion are pivotably connected by a hinge feature.

8. The plush toy of claim 2, including a door attached to the rigid body, accessible through the plush fabric covering, opening into the rigid hollow body.

9. The plush toy of claim 1, including a compressible packing material disposed inside of the plush fabric covering and disposed outside of the rigid body and the at least one expandable, articulable and positionable tube.

10. The plush toy of claim 1, including a compressible packing material disposed inside of the at least one expandable, articulable and positionable tube.

11. The plush toy of claim 1, wherein the at least one weighting material comprises a plurality of metal or plastic beads, stones, rocks, sand or water.

12. The plush toy of claim 11, wherein the at least one weighting material is sealed within the rigid hollow base.

13. The plush toy of claim 1, wherein the plush fabric covering resembles an animal.

14. The plush toy of claim 13, wherein the at least one expandable, articulable and positionable tube represents an arm, a leg, a neck, a tail or a horn of the animal.

15. The plush toy of claim 1, wherein the rigid body comprises a single component of an injection molded part.

16. The plush toy of claim 1, wherein a center of gravity of the plush toy is below the rigid body for both an expanded state and a contracted state of the at least the first expandable, articulable and positionable tube which is attached to the rigid hollow base.

17. The plush toy of claim 1, including a button electrically connected to a speaker, the button and speaker mounted to the rigid body, the speaker configured to play various sounds when the button is pressed, wherein the button and speaker are also electrically connected to a battery and circuit board configured to make the button and speaker function, wherein the battery and circuit board are disposed within the rigid body.

18. A plush toy, comprising:

a rigid body;

a plurality of expandable, articulable and positionable tubes each extending from a proximal tube end to a distal tube end, wherein each proximal tube end is attached to the rigid body;

at least two rigid hollow bases each filled with weighting material, wherein each rigid base is attached a respective distal tube end of one of the plurality of expandable, articulable and positionable tubes, and wherein each rigid hollow base has a bottom surface area ratio that includes at least 6 inches squared for every 10 inches in maximum height of the plush to in an expanded state;

wherein at least one tube of the plurality of expandable, articulable and positionable tubes is not attached to the at least two rigid hollow bases and is not configured to support the plush toy in a standing pose; and a continuous and integrally formed plush fabric covering surrounding the entirety of the rigid body, the plurality of expandable, articulable and positionable tubes and the at least two rigid hollow bases;

a compressible packing material disposed inside of the plush fabric covering and disposed outside of the rigid body and the plurality of expandable, articulable and positionable tubes;

wherein the plush fabric covering resembles an animal; and wherein at least one of the plurality of expandable, articulable and positionable tubes represents an arm, a leg, a neck, a tail or a horn of the animal;

wherein the at least two rigid hollow bases are the only features configured to support the plush toy in a standing pose.

19. A plush toy, comprising:

a rigid body;

a plurality of expandable, articulable and positionable tubes each extending from a proximal tube end to a distal tube end, wherein each proximal tube end is attached to the rigid body;

at least one rigid hollow base filled with weighting material, wherein the at least one rigid hollow base is attached a respective distal tube end of one of the plurality of expandable, articulable and positionable tubes, wherein the at least one rigid hollow base is configured to support the plush toy in a standing pose, and wherein the at least one rigid hollow base has a bottom surface area ratio that includes at least 6 inches squared for every 10 inches in maximum height of the plush to in an expanded state;

wherein at least one tube of the plurality of expandable, articulable and positionable tubes is not attached to the at least one rigid hollow base and is not configured to support the plush toy in a standing pose; and a continuous and integrally formed plush fabric covering surrounding the entirety of the rigid body, the plurality of expandable, articulable and positionable tubes and the at least one rigid hollow base;

a compressible packing material disposed inside of the plush fabric covering and disposed outside of the rigid body and the plurality of expandable, articulable and positionable tubes;

wherein the plush fabric covering resembles an animal;

wherein at least one of the plurality of expandable, articulable and positionable tubes represents an arm, a leg, a neck, a tail or a horn of the animal; and wherein a center of gravity of the plush toy is below the rigid body for both an expanded state and a contracted state of the respective one of the plurality of expandable, articulable and positionable tubes which is attached to the at least one rigid hollow base.

* * * * *